US005956865A

United States Patent [19]

Durance et al.

[11] Patent Number: 5,956,865

[45] Date of Patent: Sep. 28, 1999

[54] PROCESS FOR DRYING HERBS

[75] Inventors: Timothy Douglas Durance, Vancouver; Dragan Macura, Burnaby, both of Canada; Richard Scholmer Meyer, Tacoma, Wash.; Alex N. Yousif, Pitt Meadows, Canada; Christine H. Scaman; Jianhua (Linda) Wang, both of Vancouver, Canada

[73] Assignee: The University of British Columbia, Vancouver, Canada

[21] Appl. No.: 09/081,212

[22] Filed: May 20, 1998

[51] Int. Cl.[6] ..... F26B 3/34

[52] U.S. Cl. ..... 34/265; 34/263; 34/259; 219/678; 219/686

[58] Field of Search ..... 34/259, 263, 264, 34/92; 219/678, 686, 685; 426/638, 640

[56] References Cited

U.S. PATENT DOCUMENTS

| | | | |
|---|---|---|---|
| 4,045,639 | 8/1977 | Meisel | 219/686 |
| 4,430,806 | 2/1984 | Hopkins | 34/259 |
| 4,856,203 | 8/1989 | Wennerstrum | 34/259 |
| 5,135,122 | 8/1992 | Gross et al. | 219/685 |
| 5,227,183 | 7/1993 | Aung et al. | 426/102 |

OTHER PUBLICATIONS

Farrell, Kenneth T. "Spices, Condiments & Seasonings" 2nd Edition Chapman & Hall (1990) pp. 33–37 & 153–157.

*Primary Examiner*—Henry Bennett
*Assistant Examiner*—Pamela A. Wilson
*Attorney, Agent, or Firm*—C. A. Rowley

[57] ABSTRACT

Herbs are dried by applying microwave power to herbs in a chamber under reduced or negative pressure to reduce the moisture content of the herbs without significantly damaging the flavor of the dried herbs and produce a dried herb having a flavor more closely approaching the flavor of fresh herbs than dried herbs produced by conventional processes.

20 Claims, No Drawings

PROCESS FOR DRYING HERBS

FIELD OF THE INVENTION

The invention pertains to vacuum microwave drying of herbs.

BACKGROUND OF THE INVENTION

There is a significant flavor difference between fresh herbs and commercially available dried herbs. Consumers demand fresher flavored products and the sales of fresh herbs are growing every year. Fresh herbs obviously have a limited shelf life and thus the industry has attempted to extend the shelf life. The most successful commercial technique for extending the shelf life of herbs such as basil and oregano is by air-drying, however this process significantly alters the flavor of the herbs The essential oil of sweet basil contains about 40% linalool and 25% methyl chavicol and the remainder divided among primarily eugenol, cineole, and geraniol. Exotic basil consists of about 85% methyl charvicol and less than 1% linalool (see Farrell, Kenneth T., *Spices, Condiments, and Seasonings,* $2^{nd}$ Edition, Chapman & Hall (1990), pp. 33–37 and pp. 153–157. The components contribute significantly to the flavor of the basil.

Spanish oregano oil contains up to 50% thymol and 7–8% alpha pinene, cineole, linalyl acetate, linalool, dipentene, para cymene and beta caryophyllene, all of which contribute to the flavor of the oregano.

SUMMARY OF THE INVENTION

It is an object of the present invention to use vacuum microwave dehydration to produce a dried herb that significantly more closely approaches the flavor of the fresh herb than does conventionally air-dried herbs Broadly the present invention relates to a new process for drying a herbs so that a greater portion of the key volatile flavors are retained in the dried herb product produced comprising loading fresh herb into a vacuum microwave drying chamber, reducing the pressure in said chamber to a low pressure below 10 inches of Hg, applying microwave power to said herbs while at said low pressure at a power density of between 1 and 8 kilowatts per kg of said herb for a time period of 2 to 25 minutes while sweeping the herbs with air to achieve a uniform drying of the herbs to a moisture content of less than 20% based on the dry weight of the herbs without significantly damaging said herbs by burning.

Preferably the process further comprises reducing the application of microwave power by at least 50% when the moisture content of the herbs approaches 20% and completing the drying to a moisture content of the herb to be within the range of 8 to 11%.

Preferably said herbs is one selected from the group consisting of basil and oregano.

Preferably said herbs are tumbled or otherwise agitated during said time period during the application of microwave power Preferably said low-pressure in said chamber is below 24 inches of Hg, most preferably below 28 inches of Hg.

Preferably temperature in said chamber during said time period will not exceed 60° C., most preferably 38° C.

Preferably said sweeping said herbs with air flowing over said herbs at air flow rates using ambient air of between 3 liters per minute (lpm)/kg and 40 lpm/Kg fresh herbs.

DETAILED DESCRIPTION OF THE INVENTION

Applicant has found a vacuum microwave dehydration process that significantly increase the retention of key volatile oils in herbs such as basil and oregano when compared to air drying. Vacuum microwave drying of the present invention also improves the color of these herbs versus air-drying. The present invention provides a new process for drying herbs so that greater portions of the key volatile flavors are retained and drying time is greatly reduced.

Fresh herbs are loaded into a vacuum microwave-drying chamber, preferably of a rotating drum type which produces more even drying, however other types of microwave dries may be employed provided they can achieve the required uniform drying at the required power application in the required time.

A vacuum is pulled to produce a low pressure in the chamber of below 10 inches of Hg. Preferably the pressure will be reduced to a pressure below 24 inches of Hg. to ensure the temperature in the chamber during evaporation of water remains below 60° C. In commercial operation it is expected that in most cases the low pressure will be reduced to a pressure below 28 inches of Hg (1 p.s.i. or 70 torr) and the temperature held to below 38° C.

The higher the vacuum pressure i.e. less vacuum the longer the drying time and the higher the temperature required for drying i.e. the material being dried must be subjected to a higher temperature to evaporate water. The higher the temperature to which the herbs are subjected the more likely the herbs are to lose flavor-generating substances through evaporation. It is therefor preferred to use the highest achievable vacuum and minimize the time and temperature required to dry the herbs to thereby minimize the loss of flavor.

As above indicated the level of vacuum controls the temperature of the material being dried; however, the uniformity is controlled by adjusting the microwave power to the chamber and by the position and amount of the herbs in the microwave chamber.

The microwave power applied to the chamber is important. The higher microwave power applied to the herbs the shorter the required drying time, but if the power is too high for too long spotty burning of the herbs will occur. Too low an application of microwave power applied to the herbs is detrimental as it extends drying time and allows enzymes such as polyphenol oxidase to brown the herb and alter the fresh flavor. Generally the microwave power applied will be in the range of between 1 and 8 KW/hr/Kg of the fresh herb being processed. The use of low power application is not preferred as the process may become too slow and the flavor of the herbs damaged as above described. Application of high power i.e. above about 8 KW/Kg of the fresh herb makes controlling the uniformity of the drying process at low moisture content (i.e. below 20% moisture) more difficult. Generally an application of microwave power of about 4 KW/Kg of the fresh herb is preferred.

Drying time is controlled by the amount of vacuum and the power applied to the herbs in the chamber. It is preferred to operate using the lowest vacuum pressure (and thus the lowest drying temperature) and the highest application of microwave power in the chamber provided the power is not applied to the extent to damage the herbs being treated to complete the drying quickly while subjecting the herbs to a minimum required drying temperature.

The microwave power available for use commercially have frequencies of 2450 MHz and 915 MHz, both of which may be used, but 2450 MHz is preferred.

The pressure in the chamber should be sufficiently low to ensure the temperature of the herbs does not exceed about 60° C. and specifically for basil 38° C. and for oregano 38° C. during the drying operation.

The air flow rates, using ambient air to remove moisture, are preferably between 3 and 40 liters/minute/kg fresh herbs.

With vacuum microwave drying (VMD) it is possible to use any relative humidity (RH) in the air because the water which is converted to gas is removed by the vacuum pump.

When the dryness of the herbs approaches 20% moisture content the application of microwave power is reduced significantly i.e. by at least about 50% and in any event to a low power application less than 2 KW/Kg of the herb and is applied at this rate to reduce the moisture content of the herb to between 8 and 12%.

The drying is deemed completed when the moisture content of the herbs is reduce to at least 20% preferably between 8 and 12% based on the dry weigh of the herbs.

EXAMPLE I

Drying basil using the vacuum microwave dehydration process.

A sample of fresh basil (*Ocimum basilicum*) weighing 600 grams was placed in a drum that was inserted in a 4 KW powered microwave vacuum chamber. The initial moisture of the basil was measured at 89.9%. The drum was rotated at the rate of 11 rotations per minute. After a vacuum of 27 inches of Hg was achieved, the magnetron was powered at 4 kW/hr. for 12 minutes, followed by 2 KW/hr. for 6 minutes and then 1 KW/hr for 5 minutes. The product temperature was maintained at 45° C. The airflow rate through the chamber was 3 liters per minute using ambient air. The chamber is 26 inches in diameter and 20 inches long (measured in the axial direction). The final moisture of the basil was 9.0%.

Fresh basil from the same source used in the preceding test was air-dried using a commercial process as follows: 1 kg. of fresh basil was loaded on a Vers-a-belt dryer (Wal-Dor Industries Ltd., New Hamburg, Ont.). The dryer temperature was set at 48° F. with an airflow rate of 2.3 cubic meters/second. After 14.5 hours in the dryer, a final moisture level of 9.3% was achieved.

A commercial sample of basil produced by the McCormick Spice Company (Hunt Valley, Md., USA) was purchased. Its moisture content was measured at 9.6% moisture.

Moisture for all samples was measured in a drying oven set at 103° C.; samples were dried to a constant weight and the moisture contents were calculated from the difference between the wet weight and dried weight divided by the wet weight.

All samples were subjected to colorimetric analysis and gas chromatography analysis. For color analysis, triplicates of five grams of each basil treatment were ground in a household coffee grinder for 10 seconds to produce a ground product of uniform color. The samples were transferred to a 10 cm Petri dish, which was placed in the calorimeter chamber of the Hunter Lab calorimeter. One L, a, b, reading was taken each of the samples. See Table 1 for results. For volatile flavor analysis, volatile compounds of fresh and dried basil were extracted by a dynamic headspace technique, separated on a Varian 3700 gas chromatograph (Varian Associates, Inc., Palo Alto, Calif.), and identified by gas chromatography-mass spectrometry (GC-MS).

Six samples of the fresh or dried basil were weighed in clean Zip lock plastic bags so that the content of each bag delivers a final concentration of 0.6% (w/v, based on moisture content studies) when suspended in the preheated (60° C.) distilled water contained in a one liter purge and trap apparatus (Wheaton, Millville, N.J.). The temperature of the apparatus was held at 60° C. throughout the course of the experiment by circulating water from a water bath. Fresh samples were blended (Sunbeam blender) in a 100 ml of preheated (60° C.) distilled water until completely homogenized (30 sec.).

Dried samples, however, were crushed while inside the sealed plastic bags, and the fine dried flakes were immediately added to the purge and trap vessel.

An internal standard, tetradecane (Aldrich Chemicals, Milwaukee, Wis.) dissolved (1:100) in diethyl ether (BDH Chemicals, Toronto, ON) was added (500 $\mu$l) to the vessels, that were attached to a horizontal shaking platform, before purging the head space of the herb containing flasks with purified $N_2$ (Linde Specialty Gas, Vancouver, BC) at 50 ml. Minute$^{-1}$ for 2 hours.

Diethyl ether (2 ml) was then used to elute the volatile compounds from the porous polymer of Tenax GC (100 mg, 60–80 mesh, Alltech Co., Deerfield, Ill.) and the extract was concentrated to approximately 200 $\mu$l by directing a gentle stream of $N_2$ onto the surface. A sample (1 $\mu$l) of the concentrated extract was injected into the GC equipped with a flame ionization detector (FID) coupled to a polyethylene glycol (PEG) capillary column (Supelcowax-10, 30 m, 0.25 mm id, 0.25 um film thickness-Supelco Inc., Toronto, ON).

The column temperature was held at 35° C. for 5 minutes, programmed at 4° C. per minute to 200° C. and held for 5 minutes. The injector port a detector were set at 220° C. and 250° C., respectively.

The flow rates for helium (carrier gas) and hydrogen gas were set at 30 ml. minute$^{-1}$ and for air at 300 ml. minute$^{-14}$. Splitless injection was employed.

Identification of major volatile compounds was carried out on a Hewlett-Packard 5985 GC/MS (Hewlett-Packard, Avondale, Pa.) coupled to a DB-1 column and based on computer matching of volatile compounds published in databases. The MS was operated with an ion source temperature of 200° C., ionization voltage of 70 eV and electron multiplier at 2200 V.

The relative amount of the major volatile compounds was determined by dividing the area of a compound by peak area of the internal standard (10 to the second power). A statistical analysis was employed to evaluate the statistical significance of the differences between the various treatment groups. Student's t-test was used to compare the means of the various treatments. The statistical analysis was performed using Instat for MacIntoch (1992–93). Mean values were considered significantly different when $p<0.05$. The results are presented in Table 1.

TABLE 1

Color measurements for basil

| | VMD | air-dried | commercial |
|---|---|---|---|
| L | 35.43 +/− 0.10 | 28.70 +/− 1.15 | 32.56 +/− 0.73 |
| a | −6.55 +/− 0.20 | −1.06 +/− 0.35 | −0.23 +/− 0.08 |
| b | 10.52 +/− 2.17 | 9.89 +/− 0.61 | 10.52 +/− 0.46 |

where

L=Lightness (100=white, 0=black)

a(+red; 0 gray; −green)

b(+yellow; 0 gray; −blue)

Table 1 demonstrates that VMD (vacuum microwave dried) is greener than either air dried and commercial basil thereby demonstrating an improvement over even the fresh basil in color.

Table 2 presents the results from gas chromatography (GC) analysis of the fresh or dried samples.

TABLE 2

GC measurements of basil dried by different methods

| Column ID<br>Column Title<br>Sample # | A<br>Fresh (Peak 1)<br>Raw Data | B<br>Fresh (Peak 2)<br>Raw Data | C<br>Air (Peak 1)<br>Raw Data | D<br>Air (Peak 2)<br>Raw Data | E<br>VMD (Peak 1)<br>Raw Data | F<br>VMD (Peak 2)<br>Raw Data |
|---|---|---|---|---|---|---|
| 1 | 71.3 | 62.9 | 34.1 | 47.0 | 181.1 | 117.1 |
| 2 | 53.3 | 10.5 | 47.5 | 52.8 | 192.9 | 93.6 |
| 3 | 86.8 | 76.0 | 31.2 | 51.9 | 100.9 | 83.8 |
| 4 | 95.4 | 40.6 | 75.8 | 75.4 | 134.2 | 61.5 |
| 5 | 59.1 | 29.6 | 96.8 | 91.9 | 174.7 | 122.6 |
| 6 | 107.9 | 80.1 | 90.4 | 73.0 | | |

Peak 1 = Linalool
Peak 2 = Methylchavicol

TABLE 3

Statistical analysis of GC data from basil dried by different methods

| Column ID<br>Column Title | A<br>Fresh (Peak 1) | B<br>Fresh (Peak 2) | C<br>Air (Peak 1) | D<br>Air (Peak 2) | E<br>VMD (Peak 1) | F<br>VMD (Peak 2) |
|---|---|---|---|---|---|---|
| Mean | 78.97 | 49.95 | 62.63 | 65.33 | 156.76 | 95.72 |
| Sample size | 6 | 6 | 6 | 6 | 5 | 5 |
| Standard Deviation | 21.36 | 27.62 | 28.79 | 17.55 | 38.24 | 24.99 |
| 95% C.I. lowside | 56.55 | 20.96 | 32.42 | 46.92 | 109.28 | 64.70 |
| 95% C.I. highside | 101.38 | 78.94 | 92.85 | 83.75 | 204.24 | 126.74 |

Mean = average value for all the samples in the treatment (e.g. Fresh basil, peak 1 GC values for Linalool content).
Sample size = the number of samples of basil from that treatment which was tested in the gas chromatograph.
Standard deviation = amount of +/− deviation from the average (mean value).
95% C.I. (confidence interval) = 95% of the measured values fall between these lowside and highside values.

Mean=average value for all the samples in the treatment (e.g. Fresh basil, peak 1 GC values for Linalool content).

Standard deviation=amount of +/− deviation from the average (mean value).

95% C.I. (confidence interval)=95% of the measured values fall between these lowside and highside values.

TABLE 4

Flavor retention in basil dried by different methods

| | Statistical difference | Comments |
|---|---|---|
| Linalool | | |
| Fresh basil versus air-dried basil | no | no difference between fresh & air dried basil |
| VMD versus fresh basil | yes | VMD basil has about 2 times more Linalool than fresh basil |
| VMD versus air dried | yes | VMD basil has about 2.5 times more Linalool than air-dried basil |
| Methylchavicol | | |
| Fresh basil versus air-dried basil | no | no difference between fresh basil and air-dried basil |
| VMD basil versus fresh basil | yes | VMD basil has about 1.9 times more methylcharvicol than fresh basil |
| VMD basil versus air-dried basil | yes | VMD basil has about 1.5 times more methylcharvicol than air dried basil |

Sample size=the number of samples of basil from that treatment which was tested in the gas chromatograph.

EXAMPLE II 750 grams of fresh Basil 89.8% moisture was dried applying 4 kW/Kg of the herb of microwave power for 16.5 minute at a vacuum pressure of 27 inches of Hg. which reduced the weight of the basil to 102 grams i.e. 25% moisture and was then dried to final moisture content of 8.8% by applying power at 2 kW/Kg of the herb at a vacuum pressure of 27 inches Hg for 5 minutes.

The dried basil produced had characteristics similar to that produced following the procedure of Example 1.

EXAMPLE III

Drying oregano using the vacuum microwave dehydration process

Fresh oregano (Oreganum spp.) was dried using the same vacuum microwave process as used for basil as described in Example 1. Like wise, the oregano was air-dried using the same process described for basil. All oregano tested was from the same source.

The fresh oregano, VMD oregano and lab dried oregano were subjected to GC-MS analysis as described for basil. Five key flavor compounds were measured and were expressed as chromatographic peaks as follows:

| | | | |
|---|---|---|---|
| Peak #1 | α-pinene | Peak #2 | β-myrecene |
| Peak #3 | δ-terpinene | Peak #4 | ρ-cymene |
| Peak #5 | Thymol | | |

TABLE 5

Gas chromatography measurements of oregano dried by different methods

| Column Title Sample # | Fresh Raw Data | Air dried Raw Data | VMD Raw Data |
|---|---|---|---|
| GC values for α-pinene | | | |
| 1 | 26.7 | 29.7 | 20.1 |
| 2 | 19.6 | 14.3 | 15.5 |
| 3 | 31.1 | 16.4 | 24.0 |
| 4 | 24.3 | 14.1 | 27.3 |
| 5 | 24.9 | 20.7 | 23.5 |
| 6 | 20.6 | 24.5 | 26.7 |
| GC values for β-myrecene | | | |
| 1 | 24.4 | 22.9 | 16.8 |
| 2 | 11.7 | 13.7 | 12.5 |
| 3 | 28.0 | 11.8 | 17.9 |
| 4 | 22.7 | 9.8 | 19.0 |
| 5 | 19.2 | 18.5 | 18.1 |
| 6 | 17.7 | 18.3 | 23.1 |
| GC values for δ-terpinene | | | |
| 1 | 105.6 | 76.9 | 70.8 |
| 2 | 118.5 | 57.1 | 61.6 |
| 3 | 86.5 | 43.4 | 559 |
| 4 | 101.9 | 55.9 | 59.6 |
| 5 | 77.5 | 56.7 | 60.6 |
| 6 | 110.1 | 58.0 | 635 |
| GC values for ρ-cymene | | | |
| 1 | 112.6 | 62.4 | 62.6 |
| 2 | 66.4 | 49.8 | 53.2 |
| 3 | 69.6 | 36.6 | 49.8 |
| 4 | 91.2 | 48.1 | 50.0 |
| 5 | 64.9 | 48.6 | 46.2 |
| 6 | 54.0 | 48.5 | 50.5 |
| GC values for Thymol | | | |
| 1 | 28.6 | 24.7 | 362 |
| 2 | 18.0 | 20.1 | 29.2 |
| 3 | 32.3 | 22.4 | 28.5 |
| 4 | 32.3 | 24.3 | 28.2 |

TABLE 5-continued

Gas chromatography measurements of oregano dried by different methods

| | | | |
|---|---|---|---|
| 5 | 28.6 | 22.7 | 28.1 |
| 6 | 28.7 | 26.4 | 27.1 |

TABLE 6

Statistical analysis of GC data from oregano dried by different methods

| Values | Fresh | Air dried | VMD |
|---|---|---|---|
| Statistical analysis of GC data on α-pinene | | | |
| Mean | 24.53 | 19.95 | 22.85 |
| Sample size | 6 | 6 | 6 |
| Standard deviation | 4.19 | 6.25 | 4.43 |
| 95% C.I. lowside | 20.13 | 13.39 | 18.20 |
| 95% C.I. highside | 28.93 | 26.51 | 27.50 |
| Statistical analysis of GC data on β-myrecene | | | |
| Mean | 20.62 | 15.83 | 17.90 |
| Sample size | 6 | 6 | 6 |
| Standard deviation | 5.71 | 4.91 | 3.43 |
| 95% C.I. lowside | 14.62 | 10.68 | 14.30 |
| 95% C.I. highside | 26.61 | 20.98 | 21.50 |
| Statistical analysis of GC data on δ-terpinene | | | |
| Mean | 100.02 | 58.00 | 62.00 |
| Sample size | 6 | 6 | |
| Standard deviation | 15.28 | 10.75 | 5.00 |
| 95% C.I. lowside | 83.98 | 46.72 | 56.76 |
| 95% C.I. highside | 116.06 | 69.28 | 67.24 |
| Statistical analysis of GC data on ρ-cymene | | | |
| Mean | 76.45 | 49.00 | 52.05 |
| Sample size | 6 | 6 | 6 |
| Standard deviation | 21.49 | 8.19 | 5.63 |
| 95% C.I. lowside | 53.89 | 40.41 | 46.14 |
| 95% C.I. highside | 99.01 | 57.59 | 57.96 |
| Statistical analysis of GC data on Thymol | | | |
| Mean | 28.08 | 23.43 | 29.63 |
| Sample size | 6 | 6 | 6 |
| Standard deviation | 5.26 | 2.19 | 3.26 |
| 95% C.I. lowside | 22.57 | 21.14 | 26.21 |
| 95% C.I. highside | 33.60 | 25.73 | 33.05 |

TABLE 7

Flavor retention in oregano dried by different methods

| | Statistical difference | Mean GC-MS values and Comments |
|---|---|---|
| α-pinene | | |
| Fresh oregano versus air-dried oregano | no | 24.5 & 20.0 |
| Fresh oregano versus VMD oregano | no | 24.5 & 22.9 |
| Air-dried oregano versus VMD oregano | no | 20.0 & 22.9 |
| | | VMD is directionally better than air-dried |
| β-myrecene | | |
| Fresh oregano versus air-dried oregano | no | 20.6 & 15.3 |
| Fresh oregano versus VMD oregano | no | 20.6 & 17.9 |
| Air-dried oregano versus VMD oregano | no | 15.8 & 17.9 |
| | | VMD is directionally better than air-dried |
| δ-terpinenes | | |
| Fresh oregano versus air-dried oregano | yes | 100.0 & 58.0 |
| Fresh oregano versus VMD oregano | yes | 100.0 & 62.0 |
| Air-dried versus VMD oregano | no | 58.0 & 62.0 |
| | | VMD is directionally better than air-dried |
| ρ-cymene | | |
| Fresh oregano versus air-dried oregano | yes | 76.5 & 49.0 |
| Fresh oregano versus VMD oregano | yes | 76.5 & 52.0 |
| Air-dried versus VMD oregano | no | 49.0 & 52.0 |
| | | VMD is directionally better than air-dried |
| Thymol | | |
| Fresh oregano versus air-dried oregano | no | 28.1 & 23.4 |
| Fresh oregano versus VMD | no | 28.1 & 29.6 |
| Air-dried oregano versus VMD | yes | 23.4 & 29.6 |

With Thymol constituting up to 50% of the volatile flavor, VMD is significantly better than air dried and equal to fresh in the most critical key flavor Having described the invention modifications will be evident to those skilled in the art without departing from the spirit of the invention as defined in the appended claims.

We claim:

1. A process for drying herbs so that a greater portion of the key volatile flavors are retained in the dried herbs produced comprising loading fresh herbs into a vacuum microwave drying chamber, reducing the pressure in said chamber to a low pressure below 10 inches of Hg, applying microwave power to said herbs while at said low pressure with a power density of between 1 and 8 Kilowatts/Kg of said herb for a time period of 2 to 25 minutes while sweeping the herbs with air to achieve a uniform drying of the herbs to a moisture content of less than 20% based on the dry weight of the herbs without significantly damaging said herbs by burning.

2. A process as defined in claim 1 further comprising reducing the application of microwave power by at least 50% when the moisture content of the herbs approaches 20% and completing the drying to a moisture content of the herbs to less than 10%.

3. A process as defined in claim 2 wherein said low pressure in said chamber is below 24 inches of Hg.

4. A process as defined in claim 2 wherein said low pressure in said chamber is below 28 inches of Hg.

5. A process as defined in claim 4 wherein said sweeping said herbs with air flowing air over said herbs at air flow rates using dry air of between 3 and 40 liters/minute/Kg fresh herbs.

6. A process as defined in claim 1 wherein said herbs is one selected from the group consisting of basil and oregano.

7. A process as defined in claim 2 wherein said herbs is one selected from the group consisting of basil and oregano.

8. A process as defined in claim 7 wherein said low pressure in said chamber is below 24 inches of Hg.

9. A process as defined in claim 7 wherein said low pressure in said chamber is below 28 inches of Hg.

10. A process as defined in claim 6 wherein said low pressure in said chamber is below 24 inches of Hg.

11. A process as defined in claim 10 wherein temperature in said chamber during said time period will not exceed 60° C.

12. A process as defined in claim 6 wherein said low pressure in said chamber is below 28 inches of Hg.

13. A process as defined in claim 12 wherein temperature in said chamber during said time period will not exceed 60° C.

14. A process as defined in claim 12 wherein said sweeping said herbs with air flowing air over said herbs at air flow rates using dry air of between 3 and 40 liters/minute/Kg fresh herbs.

15. A process as defined in claim 1 wherein said herbs are tumbled during said time period during the application of microwave power to obtain more uniform drying.

16. A process as defined in claim 1 wherein said herbs are tumbled during said time period during the application of microwave power to obtain more uniform drying.

17. A process as defined in claim 1 wherein said low pressure in said chamber is below 24 inches of Hg.

18. A process as defined in claim 1 wherein said low pressure in said chamber is below 28 inches of Hg.

19. A process as defined in claim 18 wherein said sweeping said herbs with air flowing air over said herbs at air flow rates using ambient air of between 3 and 40 liters/minute/Kg fresh herbs.

20. A process as defined in claim 18 wherein temperature in said chamber during said time period will not exceed 60° C.

* * * * *